US006276464B1

(12) United States Patent
Draney et al.

(10) Patent No.: US 6,276,464 B1
(45) Date of Patent: Aug. 21, 2001

(54) STAKE COUPLER FOR A HORIZONTAL DIRECTIONAL DRILL

(75) Inventors: Robert G. Draney, Derby, KS (US); Donald C. Sassor, Osceloa, WI (US); Jeffrey S. Volden, Burlington, IA (US)

(73) Assignee: Case Corporation, Racine, WI (US)

( * ) Notice: Subject to any disclaimer, the term of this patent is extended or adjusted under 35 U.S.C. 154(b) by 0 days.

(21) Appl. No.: 09/500,820

(22) Filed: Feb. 10, 2000

(51) Int. Cl.[7] ..... E21B 15/04

(52) U.S. Cl. ..... 173/32; 173/186; 173/132; 175/122; 166/96.1

(58) Field of Search ..... 173/32, 31, 91, 173/186, 187, 132; 403/349, 348; 175/122, 22, 162, 321, 20; 285/396; 166/96.1

(56) References Cited

U.S. PATENT DOCUMENTS 3,834,761 * 9/1974 Ray et al. ..... 173/186
4,343,370 * 8/1982 Chatard et al. ..... 175/321
4,474,488 * 10/1984 Pinkerton et al. ..... 403/349
4,625,804 * 12/1986 Allen, Jr. ..... 166/338
4,986,690 * 1/1991 Cooksey ..... 403/348
5,168,944 * 12/1992 Andersson ..... 175/321
5,253,961 * 10/1993 Geissler ..... 173/71
5,542,476 * 8/1996 Hansen ..... 172/22
5,741,084 * 4/1998 Del Rio et al. ..... 403/349
5,901,799 * 5/1999 Koenig ..... 285/396
6,102,135 * 8/2000 Shaw ..... 175/20
6,126,359 * 10/2000 Dittrich et al. ..... 403/349
6,131,674 * 10/2000 Draney et al. ..... 173/32

* cited by examiner

*Primary Examiner*—Scott A. Smith
(74) *Attorney, Agent, or Firm*—Richard G. Lione; Brinks Hofer Gilson & Lione

(57) ABSTRACT

A coupling for quickly and easily attaching and detaching stakes from the drive head of a horizontal directional drill. The coupling includes an upper coupler member and a lower coupler member. The lower coupler member slides into the upper coupler member, and a pin in the upper coupler member rotates into opposed, horizontal slots in the lower coupler member.

3 Claims, 2 Drawing Sheets

STAKE COUPLER FOR A HORIZONTAL DIRECTIONAL DRILL

FIELD OF THE INVENTION

The present invention relates generally to horizontal directional drill machines. It relates particularly to the stakedown assembly for a horizontal directional drill machine.

BACKGROUND OF THE INVENTION

A horizontal directional drill machine is commonly employed for installing pipes beneath the ground and generally parallel to the surface. These machines are used in many different applications and are available in a wide range of sizes. Typical applications where a horizontal directional drill machine might be used include the installation of fiber optic cables, electrical cables, gas lines, water systems, or sewer systems. Horizontal directional drill machines are commonly rated in terms of pull-back capacity. Some machines for smaller applications have as little as five thousand pounds of pull-back capacity. Other machines are available with a pull-back capacity of as much as one million pounds.

One alternative to a horizontal directional drill machine is the traditional trencher machine. A trencher machine simply digs a trench into the ground, and after (for example) pipe is laid down in the bottom of the trench, the trench is filled and the pipe is buried. The advantage of a horizontal directional drill machine over a trenching machine is that a pipe can be buried in the ground over long distances without digging a trench. Thus, a horizontal directional drill is particularly desirable when a trench would be difficult or too costly to dig. For example, a horizontal directional drill machine finds particularly advantageous application for installing pipes under roadways, where destruction of the road is expensive and inconvenient to travelers, or under a waterway like a river, where trenching would be impossible.

A unique aspect of a horizontal directional drill machine is the special drill head that is attached to the front end of a pipe to be laid. The drill head has an angled shape which allows the operator to change the direction of the pipe after it has entered the ground. Direction changes are achieved by stopping the pipe and drill head rotation and orienting the drill head at a desired angle. Then, by pushing on the drill pipe without rotating it, the drill head and attached pipe will veer in the desired direction. Thus, by effecting directional changes to pipe travel, a pipe might enter the ground at one angle, travel horizontally over a long distance, and exit the ground at another angle. This ability to change the direction of pipe travel also allows the operator to steer the pipe around underground obstacles like boulders.

In addition to pushing forces which must be applied to the pipe as it is inserted, it is often necessary to pull back on the pipe. This may be necessary when a direction change is not completely successful on the first attempt, or when an underground obstacle like a boulder is encountered. The machine then pulls the pipe and drill head back to permit a direction change.

The push and pull forces that a horizontal directional drill machine must apply to the drill pipe frequently exceed the weight of the machine itself. Therefore, a system is required to anchor the machine and resist these forces. The most common system for anchoring the drill machine comprises the use of stakes mounted on the machine body which are screwed into the ground. The stakes have flighting on their tips and are driven into the ground by applying simultaneous rotational and vertical driving forces to each stake. To drive and remove these stakes, a stakedown assembly is conventionally provided on the end of the drill machine where the drill head enters the ground.

A common stakedown assembly in the prior art includes a single drive head which is fixed in one position. This type of stakedown assembly provides a single location, predetermined by the manufacturer, at which a stake can be driven. Other stakedown assemblies, also in the prior art, have two drive heads so that two stakes can be installed into the ground for extra holding strength, or a single stake can be installed in either of the two available locations. Depending on the push-pull forces required and the texture of the ground material, however, a single stake may not be adequate to securely hold the machine in place. Several stakes may be required. The subsurface of the underlying ground may contain obstacles such as large rocks or previously buried pipes or lines which limit the locations where a stake may be installed. So, the two drive head assembly is frequently inadequate. Furthermore, the two drive head assembly is limited in the number of possible stake installation locations and suffers from the higher cost and added complexity associated with the use of dual components.

In a recently developed stakedown assembly, however, a single drive head can drive stakes into a variety of locations. This stakedown assembly is described and illustrated in Draney et al. U.S. patent application Ser. No. 09/495,136. This type of stakedown assembly reduces cost by requiring only a single drive head, but also provides added flexibility by allowing multiple stakes to be installed in varying locations. This added flexibility allows the stakes to be optimally placed to avoid underground obstacles and to gain maximum holding strength.

Because a variable position drive head assembly, as previously described, must be able to drive several different stakes, the stakes can not be rigidly attached to the drive shaft, but instead must be releasably connected to the drive shaft. It is therefore desirable to have a coupling that will allow quick and easy attachment and detachment of the stakes from the drive head.

BRIEF SUMMARY OF THE INVENTION

It is an object of the present invention to provide a new and improved releasable coupler for coupling stakes and the drive shaft of a stake assembly drive motor.

It is another object to provide a coupler which facilitates simple and rapid coupling and decoupling from the stake.

According to the invention, the coupler includes an upper coupler member and a lower coupler member. The upper coupler member includes a cylindrical fitting having a cylindrical attachment pocket formed upwardly into its lower end. A pin is installed transversely through the socket and extends.

The lower coupler member comprises a cylindrical fitting having an outer diameter which is slightly smaller than the inner diameter of the socket, so as to permit a sliding fit between the two members.

The lower coupler fitting has a transverse, vertical slot that extends through, and longitudinally downward, from the top of the member. It has two circumferential horizontal slots which each extend around a portion of the circumference of the lower fitting coupler. The vertical slot intersects the horizontal slots at about the midpoint of the fitting.

The lower coupler fitting is fastened to a stake. Its fitting is slidably received upwardly into the upper fitting until the pin in the upper coupler fitting is seated in the bottom of the vertical slot. Then, the upper fitting is rotated on its axis in its driving direction and the fittings are interlocked.

BRIEF DESCRIPTION OF SEVERAL VIEWS OF THE DRAWINGS

The invention, including its construction and method of operation, is illustrated more or less diagrammatically in the drawings, in which.

DETAILED DESCRIPTION OF THE INVENTION

Figure 1:
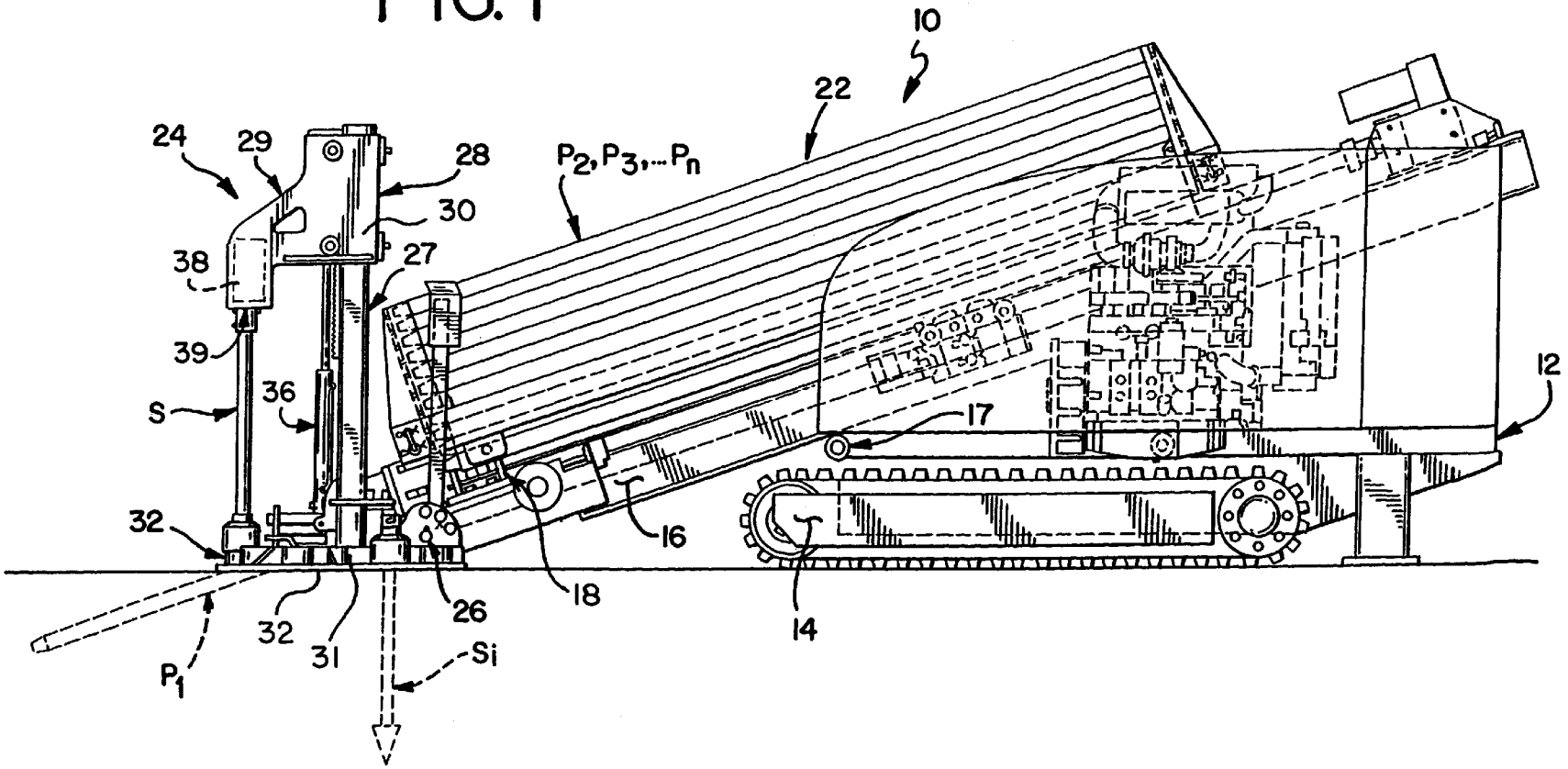
FIG. 1 is a side elevational view of a horizontal directional drill, showing the drill in its operating mode.

Referring now to the drawings, and particularly to FIG. 1, a horizontal directional drill machine is shown generally at 10. The drill machine 10 includes a frame 12 supported by driven tracks 14 for moving the drill machine 10 from place to place.

The drill machine 10 includes a longitudinally elongated boom 16 pivotally mounted on the front end of the frame 12, as at 17. A conventional pipe drill assembly 18 is mounted on the boom 16, extending coextensively therewith. The drill assembly 18 is designed to drill a series of pipe sections $P_1$, $P_2$, $P_3$, et seq., into the ground, in sequence.

In the operating mode of the drill machine 10, the boom 16 is pivoted upward away from the frame 12 so that pipe section $P_1$ extends from the drill assembly 18 and intersects the ground at an angle. A special drill head (not shown) is attached to the front end of the first drill pipe section $P_1$. In order to drill the pipe section $P_1$ into the ground and make any desired directional changes in its path, a variety of push, pull, and rotational forces are applied to the pipe section $P_1$ by the drill assembly 18. The manner in which the drill assembly 18 applies these forces to the drill pipe section $P_1$ are not described, but are well known to those skilled in the art.

As the first pipe section $P_1$ is drilled into the ground, new pipe sections $P_2$, $P_3$, et seq., are successively attached to the rear end of the preceding pipe sections. A cartridge 22 of pipe sections $P_2$, $P_3$, et seq. is provided on the boom 16 for storing these additional pipe sections, and a semi-automatic or fully automatic loader (not shown) may be provided for attaching them to the preceding pipe sections.

A stakedown assembly 24 is connected to the front end of the drill machine 10. The stakedown assembly 24 is connected to the forward end of the boom 16 at a pivot connection 26, which allows the stakedown assembly to be oriented level with the ground surface when the boom is tilted.

Figure 2:
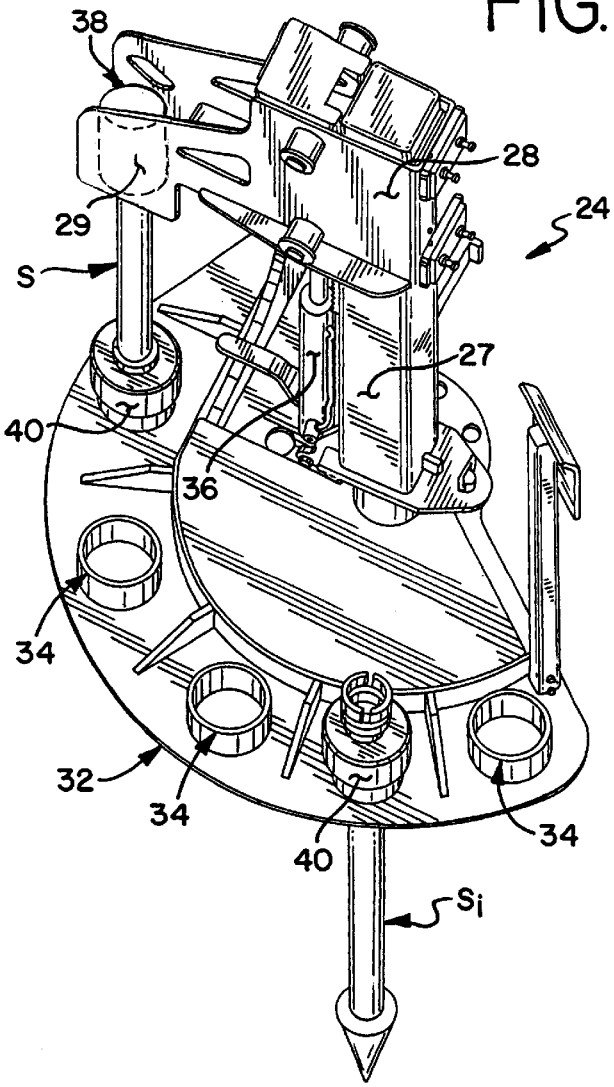
FIG. 2 is a perspective view of a stakedown assembly, with one stake installed into the ground and a second stake positioned under the drive head for installation.

Turning now to FIG. 2, a stakedown assembly 24 is shown in greater detail. The stakedown assembly 24 includes a tower 27 mounted on a base plate 32 at a connection 31 which permits the tower 27 to rotate about its vertical axis. A drive head 28 is attached to the tower 27 through a sleeve 30 which permits longitudinal sliding along the tower 27, and a cantilevered arm 29 on which the drive head 28 is mounted.

The lower end of a hydraulic cylinder 36 is pivotally attached to the tower 27, while the upper end is pivotally attached to the arm 29. Thus, the arm 29 and drive head 28 can be driven in a vertical direction by the hydraulic cylinder 36.

The base plate 32 has a series of stake locator ports 34 extending vertically through it, for receiving stakes S when they are installed. These ports 34 are arranged in a semi-circular pattern at equal distances from the tower's 27 axis of rotation. The cantilevered arm 29 extends outwardly over the path of the ports 34 so that the drive head 28 can be positioned over any one of them as the tower 27 is rotated.

A drive motor 38 with a vertical output shaft 39 is mounted in the drive head 28 on the free end of the cantilevered arm 29. By rotating the tower 27, the output shaft 39 of the motor 38 can be positioned over any one of the guide ports 34. The tower is rotated manually by the operator.

To operate the multiple position stakedown assembly 24, the desired number of stakes S to be installed, and their placement, is first determined by testing soil conditions and locating any underground obstacles. The drive head 28 is rotated until its cantilevered arm 29 is over a desired guide port 34, and then locked into position. The bottom end of a stake S is positioned in the desired guide hole 34, and the top end of the stake S is attached to the drive shaft 39 of the motor 38 with a coupling 48 embodying features of the present invention.

Figure 3:
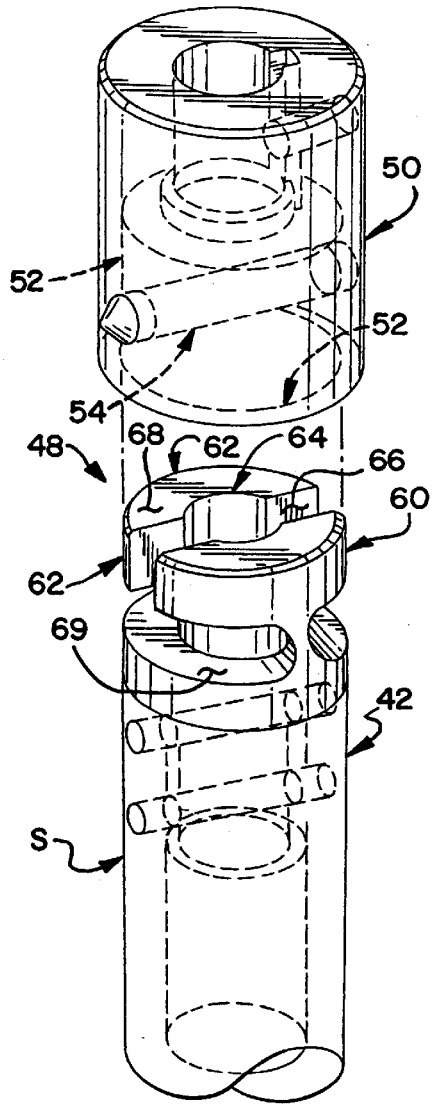
FIG. 3 is a perspective view of the coupling, in a disconnected position.

Turning now to FIG. 3 and the present invention, the coupling 48 includes the lower coupler member 60 and an upper coupler member 50. The lower coupler member 60 is mounted on the top end 42 of the stake 30. The upper coupler member 50 is mounted on the lower end of the drive shaft 39 from the drive motor 38.

The upper coupler member 50 comprises a cylindrical fitting 52. The cylindrical fitting 52 has an attachment bore 53 formed coaxially in its upper end. A large diameter coupling socket 54 is formed coaxially in its lower end. A coupling pin 55 is mounted in the socket 54, extending transversely through the fitting 52.

The lower coupler member 60 comprises a cylindrical fitting 62 having a body 63 with an outer diameter slightly smaller than the inner diameter of the socket 54, so as to provide a sliding fit between the two coupler members 50, 60. A coaxial clearance fore 64 is in the fitting body 63 provided with an inner diameter of immaterial size. A transverse, vertical slot 66 extends through the body 63, downward from the top end 68 of the fitting body. Two circumferential, horizontal slots 69 extend around opposite sides of the fitting body 63, at a location displaced from its top end, each extending through an arc of about 160°, i.e., about 80° to each side of the center line of the vertical slot 66.

The coupling 48 is engaged by placing a stake S with an attached lower coupler member 60 directly below the upper coupler member 50. The drive shaft 39 of the drive motor 38 is then rotated so that the pin 54 in the upper coupler member 50 is aligned with the vertical slot 66 of the lower coupler member 60. Next, the drive head 28 is lowered, without drive shaft 39 rotation, so that the pin 55 slides into the slot 66. When the pin 55 has been lowered sufficiently so that it is aligned with the horizontal slot 69, the drive shaft 39 is rotated until opposite ends of the pin 55 contact the ends of the slot 69. The stake 30 and the coupling 48 are then ready for the simultaneous rotational and vertical forces necessary to drive the stake 30 into the ground.

The driven stake S is then clamped to the base plate 32. To this end, a cap 40 is installed on each of the stakes S. The cap 40 has an inner diameter clearance hole through its center which is large enough to provide a sliding fit between the cap 40 and the stake S, but is smaller than the lower coupler member 60 which is fixedly attached to the top end of the stake S. Because its outer diameter is larger than that of the guide ports 34, the cap 40 is sandwiched between the base plate 32 and the lower coupler member 60 when the stake S is fully driven into the ground.

After disconnecting the first installed stake S from the drive shaft 39, additional stakes S can be installed. To do so, the drive head 28 is rotated to a new position and the stake installation process is repeated.

While a preferred embodiment of the invention has been described, it should be understood that the invention is not so limited, and modifications may be made without departing from the invention. The scope of the invention is defined by the appended claims, and all devices that come within the meaning of the claims, either literally or by equivalence, are intended to be embraced therein.

What is claimed is:

1. A stakedown assembly for a horizontal drill machine, comprising:

a) a drive head mounted on a base member for vertical movement relative to said base member;

b) said drive head including a vertically oriented drive shaft extending downwardly from a drive motor;

c) a shaft coupler member, said shaft coupler member including a fitting connected to the lower end of said shaft, said shaft coupler member fitting containing a cylindrical attachment socket extending vertically upwardly and a drive pin extending transversely across said socket;

d) a vertically oriented stake;

e) a stake coupler member, said stake coupler member including a fitting connected to the upper end of said stake, said stake coupler member fitting having a cylindrical body with an outside diameter slightly smaller than the inside diameter of said cylindrical attachment socket whereby said cylindrical body is slidably received upwardly into said socket;

f) said cylindrical body having a top end and containing a co-axial bore extending downward from said top end and a vertical slot also extending downward from said top end as well as transversely across the width of said body;

g) said cylindrical body containing two circumferential horizontal slots extending around opposite sides of the fitting body and to each side of the centerline of said vertical slot;

h) whereby when said cylindrical body is inserted upwardly into said socket, said pin passes through said vertical slot until it reaches said horizontal slots, after which said body can be rotated in either direction about its axis into said horizontal slots to lock said first and second coupler members together for axial and rotational driving or withdrawal of said stake by said drive motor.

2. The stakedown assembly of claim 1 further characterized in that:

a) said horizontal slots each extend through an arc more than 90°.

3. The stakedown assembly of claims 2 further characterized in that:

a) said horizontal slots each extend through on arc of approximately 80° to each side of the center line of said vertical slot.

* * * * *

UNITED STATES PATENT AND TRADEMARK OFFICE

CERTIFICATE OF CORRECTION

PATENT NO. : 6,276,464 B1
DATED : August 21, 2001
INVENTOR(S) : Robert G. Draney et al.

It is certified that error appears in the above-identified patent and that said Letters Patent is hereby corrected as shown below:

Claim 3,
Line 3, delete "on" and substitute -- an -- in its place.

Signed and Sealed this

Nineteenth Day of March, 2002

*Attest:*

*Attesting Officer*

JAMES E. ROGAN
*Director of the United States Patent and Trademark Office*